US008141869B2

(12) United States Patent
Benjaminsson et al.

(10) Patent No.: US 8,141,869 B2
(45) Date of Patent: Mar. 27, 2012

(54) ARRANGEMENT FOR STACKING SHEETS

(75) Inventors: Peter Benjaminsson, Ljungby (SE); Jan-Erik Persson, Bolmso (SE)

(73) Assignee: Lasermax Roll Systems AB, Ljungby (SE)

( * ) Notice: Subject to any disclaimer, the term of this patent is extended or adjusted under 35 U.S.C. 154(b) by 0 days.

(21) Appl. No.: 12/733,254

(22) PCT Filed: Aug. 14, 2008

(86) PCT No.: PCT/SE2008/050923

§ 371 (c)(1),
(2), (4) Date: May 10, 2010

(87) PCT Pub. No.: WO2009/025612

PCT Pub. Date: Feb. 26, 2009

(65) Prior Publication Data

US 2010/0283197 A1 Nov. 11, 2010

(30) Foreign Application Priority Data

Aug. 20, 2007 (SE) ..... 0701892

(51) Int. Cl.
*B65H 29/70* (2006.01)
*B65H 43/04* (2006.01)
*B65H 31/00* (2006.01)

(52) U.S. Cl. ..... 271/188; 271/209; 271/198

(58) Field of Classification Search ..... 271/209, 271/188, 200, 198, 307, 189
See application file for complete search history.

(56) References Cited

U.S. PATENT DOCUMENTS 2,261,972 A 11/1941 Matthews
4,157,177 A * 6/1979 Strecker ..... 271/197
4,313,669 A * 2/1982 Larson et al. ..... 396/661
4,346,881 A 8/1982 Frye
(Continued)

FOREIGN PATENT DOCUMENTS

EP 0192211 2/1986
(Continued)

*Primary Examiner* — Kaitlin Joerger
*Assistant Examiner* — Patrick Cicchino
(74) *Attorney, Agent, or Firm* — Bacon & Thomas, PLLC

(57) ABSTRACT

The invention relates to an arrangement (1) for conveying of sheets (2*a, b*), comprising upper and lower receiving rolls (3, 4), an upper belt element (5) and a receiving surface (6). The belt element (5) extends in a region above the receiving surface (6). The sheets (2*a, b*) are conveyed in a substantially horizontal direction of movement (7) towards the receiving rolls (3, 4), which receiving rolls (3, 4) during rotation move the sheets (2*a, b*) one after another between and past the receiving rolls (3, 4), during which the respective sheet (2*a, b*), after passing between and past the receiving rolls (3, 4), are situated between said receiving surface (6) and upper belt element (5). The sheets (2*a, b*) between the upper belt element (5) and the receiving surface (6) are placed on one another such that a rear edge (8) of a sheet (2*a*) passing through and between the receiving rolls (3, 4) is overlapped by a front edge (9) of a following sheet (2*b*). A lifting means (10) situated in the sheet movement direction (7) after the receiving rolls (3, 4) is adapted to acting upon sheets (2*a, b*) passing through the receiving rolls (3, 4) and over the lifting means such that the front edge (9) of a sheet (2*b*) which has passed over and past the lifting means (10) assumes a shape which strengthens the sheet (2*a, b*) in the sheet movement direction (7).

12 Claims, 4 Drawing Sheets

U.S. PATENT DOCUMENTS

| | | | | | |
|---|---|---|---|---|---|
| 4,428,574 | A | * | 1/1984 | Kataoka | 271/307 |
| 4,538,801 | A | | 9/1985 | Van Pelt | |
| 4,577,852 | A | * | 3/1986 | Grunder | 271/188 |
| 4,898,570 | A | | 2/1990 | Luperti et al. | |
| 5,102,117 | A | * | 4/1992 | Henn et al. | 271/189 |
| 5,192,068 | A | | 3/1993 | Parker et al. | |
| 5,265,861 | A | | 11/1993 | Schaffner et al. | |
| 5,344,136 | A | * | 9/1994 | Capdeboscq | 271/189 |
| 5,397,120 | A | * | 3/1995 | Schulz et al. | 271/198 |
| 5,419,548 | A | * | 5/1995 | Ueda et al. | 271/294 |
| 5,671,920 | A | * | 9/1997 | Acquaviva et al. | 271/307 |
| 5,909,873 | A | | 6/1999 | Littleton | |
| 6,189,884 | B1 | | 2/2001 | Jeske | |
| 6,338,482 | B1 | | 1/2002 | Geske et al. | |
| 7,913,999 | B2 | * | 3/2011 | Moore | 271/182 |
| 2005/0082745 | A1 | | 4/2005 | Williams et al. | |
| 2009/0001651 | A1 | * | 1/2009 | Miwa | 271/4.08 |

FOREIGN PATENT DOCUMENTS

| | | | |
|---|---|---|---|
| EP | 0192211 | A2 | 8/1986 |
| EP | 0962414 | | 12/1999 |
| GB | 985227 | | 5/1962 |
| GB | 985227 | A | 3/1965 |
| GB | 1086460 | | 6/1965 |
| GB | 1081315 | | 8/1965 |
| GB | 1640672 | | 3/1977 |

* cited by examiner

ARRANGEMENT FOR STACKING SHEETS

FIELD OF THE INVENTION

The present invention relates to an arrangement for conveying of sheets through said arrangement according to the preamble of claim 1. Such arrangements are commonly used, for example, in post-treatment equipment in paper printing.

BACKGROUND TO THE INVENTION

Before being stacked, sheets for stacking in and to a pile are traditionally connected to one another and wound on a reel. From the reel, the sheets, in the form of a continuous web, are conveyed into a cutting device which cuts them to a suitable size for individual sheets. After said cutting, the sheets are conveyed to a stacking arrangement which makes it possible for them to be stacked on one another in a single process. The stacking arrangement is so arranged that the sheets are first placed mutually in line on a conveyor belt which carries them to a stacking region. The sheets are placed on the conveyor belt such that a rear edge of each sheet is overlapped by a front edge of a following sheet. Having the sheets thus mutually overlapping makes it possible for them to be stacked on one another without becoming jammed. This is because each following sheet slides over, and will thus be placed on top of, the sheet preceding it.

European patent application EP-0192211-A2 refers to an arrangement in which sheets are placed on a conveyor belt. The sheets in EP-0192211-A2 are placed on the conveyor belt such that a rear edge of each sheet is overlapped by a front edge of a following sheet. A problem with EP-0192211-A2 is that it cannot handle thin sheets which are not stiff enough. If a sheet is too thin or not stiff enough, the result in EP-0192211-A2 is that when a sheet has to be moved from the conveyor belt to the arrangement for the formation of a stack of sheets, the front edge of the sheet will deflect downwards at the transition between the conveyor belt and the stack, with the result that the sheet is damaged and the stacking process has to be interrupted.

British patent specification GB-985227 refers to variants of an arrangement comprising a downpresser which presses down the rear edge of a sheet which is being transferred from a conveyor belt to another conveyor belt which moves at a slower speed. The fact that the downpresser pushes the rear edge down makes it possible for the front edge of a following sheet to overlap the pressed-down rear edge of the preceding sheet. A problem with that embodiment is that the downpresser is movable and rotatable. Such a movable element runs quite a large risk of disintegrating, thereby possibly resulting in the whole arrangement disintegrating. A further problem with the downpresser is that it may leave impressions in the sheet pressed down.

A problem with the inventions according to EP-0192211-A2 and GB-985227 is that they are not configured to be able to handle thin sheets but only so-called normal sheets, e.g. sheets with paper thickness corresponding to usual traditional writing paper. This means that sheets thinner than such writing paper which are used in the inventions according to EP-0192211-A2 and GB-985227 will become jammed, with consequent interruption of the sheet stacking processes.

SUMMARY OF THE INVENTION

An object of the present invention is to provide an arrangement in which the aforesaid problems are eliminated.

A further object of the present invention is to provide an arrangement which can convey sheets on a conveyor belt on which they are placed such that a rear edge of each sheet is overlapped by a front edge of a following sheet.

A further object of the present invention is to provide an arrangement in which a front edge of each sheet is stiffened in its running direction.

A further object of the present invention is to provide an arrangement which can cope with conveying and handling of paper which is curved through having been stored in a reel of continuous paper sheet.

A further object of the present invention is to provide an arrangement in which the reliability of sheet conveying is improved relative to the state of the art.

A further object of the present invention is to provide an arrangement which is cost-effective as compared with the state of the art and is easy to construct, making it possible to optimize both cost and time.

The abovementioned and other objects are achieved according to the invention by the arrangement described in the introduction having the characteristics indicated in claim 1.

An advantage achieved with an arrangement according to the characterizing part of claim 1 is that it makes it possible to convey and stack thin sheets at a high speed. The need to use sheets which are as thin as possible has arisen because thin sheets not only occupy less space but are also less expensive. Another reason for wishing to use thinner sheets is that a reel can accommodate more of them than a reel of traditional sheets of normal thickness.

According to an embodiment of the invention, the lifting means acts upon the front edge in a forward portion of the sheet, as viewed in a section through said forward portion of the sheet and transversely to the direction of movement of the sheet, by the sheet being conveyed over the lifting means, whereby the front edge and the sheet assume a wavy shape comprising a number of ridges and valleys which are parallel with the direction of movement, thereby stiffening the sheet in said direction of movement. Said ridges and valleys serve as a beam element in the sheet. The stiffening contributes to the front edge of the sheet, after passing over the lifting means, partly maintaining its shape in the sheet movement direction by the front edge partly following parallel with and in direct proximity to the upper belt element of the lower belt portion until the belt elements mutually coincide in the same direction of movement.

According to an embodiment of the invention, the lifting means comprises a number of grooves extending in the direction of movement in a surface of the lifting means, which surface said sheets pass over. Said grooves in the surface of the lifting means are deeper on the side of the lifting means which faces away from the receiving rolls than the grooves in the portion of the surface of the lifting means which is closer to the receiving rolls. The grooves in the lifting means are so configured that the upper belt element, by its configuration, fits in the grooves. In the lifting means, the grooves are disposed vertically below the respective belt elements which extend above said lifting means, and the latter comprises at least as many grooves as the number of belt elements. Upon movement of the adjustable roll towards the receiving rolls, the upper belt element is acted upon by part of said belt elements moving closer to the lifting means. The grooves provided in the lifting means make it possible for the respective belt elements approaching the lifting means to fit into the respective grooves. When a sheet is conveyed between the lifting means and the belt element, the sheet is thus partly pressed down by the belt element into the respective grooves and thereby assumes a stiffening wavy shape in the sheet movement direction. A further advantage is that the belt element is not caused to slide over an edge portion of the lifting means and thereby be subject to wear due to friction between it and the lifting means. When the adjustable roll is moved in the sheet movement direction, said portion of the belt element is acted upon such that the upper belt element is instead moved upwards and away from said grooves, thereby creating an intermediate space between the lifting means and the upper belt element.

According to a further embodiment of the invention, the lifting means is an elongate means with a length corresponding to at least the width of a sheet which passes between the receiving rolls, which lifting means is situated parallel to said receiving rolls. The surface of the lifting means, which surface said sheet passes over, is adjustable in that the lifting means can be adjusted in the height direction and be rotated about an axis through the lifting means. During operation of the arrangement, the lifting means is fixed in a specified position. The surface is angled relative to the sheet movement direction such that when a sheet passes between the receiving rolls, its front edge meets, after the receiving rolls, said surface of the lifting means. A perpendicular in the surface has a main direction towards the upper receiving roll. This means that the front edge of the sheet can be brought into a partly upward path over the lifting means after passing between the receiving rolls.

According to a further embodiment of the invention, the arrangement comprises an adjustable roll situated in the sheet movement direction after, and parallel to, the receiving rolls such that the lifting means, as viewed in the movement direction, is situated between the upper receiving roll and the adjustable roll. The position of the lifting means between the receiving roll and the adjustable roll prevents the front edge of sheets passing through arrangement, between and past the receiving rolls, from deflecting downwards after the receiving rolls and thereby becoming jammed in the arrangement.

According to a further embodiment of the invention, part of the upper belt element extends partly in a first span and partly in a second span, which first span extends from an underside on the upper receiving roll to an underside on the adjustable roll, which second span extends in the movement direction from the underside on the adjustable roll to an underside on an end roll, which first and second spans jointly form, at the point where they meet on the underside of the adjustable roll, an angle of less than 180° upwards towards the upper belt element. Said angle between the first and second spans becomes smaller upon movement of the adjustable roll in a parallel direction towards the receiving rolls. The first span imparts to a sheet which passes between the receiving rolls a stiffening front edge as a result of the first span of the belt element pressing the sheet down into the grooves of the lifting means, whereupon the sheet assumes the previously mentioned wavy shape. The second span ensures that the sheet continues its movement over an underlying sheet preceding it through the arrangement.

According to a further embodiment of the invention, the lifting means acts upon the rear edge of a sheet passing over the lifting means such that said rear edge, after passing over and past the lifting means, is caused to move towards the receiving surface at a speed higher than the speed which the receiving surface has in its movement in a direction away from the receiving rolls. When the sheet has passed over and past, and no longer has any contact with, the lifting means, the rear portion of the sheet will drop towards the receiving surface. The lifting means is situated at a level above the level of the receiving surface. This means that the rear edge of the sheet drops towards said receiving surface under the action of gravity.

According to a further embodiment of the invention, the receiving surface is a continuous belt means which has an upper portion parallel with part of the upper belt element, which portion of the upper belt means and said part of the upper belt element both run in the same direction of movement but said part of the upper belt element moves at a speed higher than the speed at which said portion of the belt means moves. The upper belt element has contact with a sheet passing through the arrangement when the sheet passes between the receiving rolls, as a result of the sheet having contact with the first span of the belt element. When the belt element changes to the second span, the sheet ceases to be in contact with the belt element. This is because the second span of the belt element runs at a level above sheets situated on the receiving surface. The receiving surface causes the sheets to move at a slower speed. As sheets are conveyed between and past the receiving rolls at a first speed and are thereafter placed on the receiving surface which causes them to move at a slower second speed, they will be caused to arrange themselves such that a following sheet overlaps a preceding sheet. The result is that the sheets form a mutual queuing pattern resembling a pattern of scales on a fish.

According to a further embodiment of the invention, the movement of each sheet in the direction of movement, after passing over and past the lifting means, is reduced by the front edge of the sheet reaching a braking wheel at which the respective sheet is placed on top of a preceding sheet such that the respective front edge of adjacent sheets on the receiving surface overlaps the rear edge of a preceding sheet on the receiving surface. The braking wheel causes overlapping sheets placed in line on the receiving surface to have a constant or predetermined distance between the respective front edges of the successive overlapping sheets in the row.

According to a further embodiment of the invention, the movement of each sheet in the direction of movement, after passing over and past the lifting means, is halted by the front edge of the sheet reaching a stop membrane, whereupon the respective sheet is placed on top of a preceding sheet in a stack on the receiving surface. Each time a sheet is placed on it, the receiving surface moves downwards such that a vertical stack of sheets is created on the receiving surface. The receiving surface imparts a vertical movement to sheets by its downward movement in response to each further sheet being placed on it, whereby a stack of sheets is created on the receiving surface. When the stack comprises a desired number of sheets or reaches a desired height, it is conveyed away from the arrangement.

BRIEF DESCRIPTION OF THE DRAWINGS

A preferred embodiment of the arrangement according to the invention is described below in more detail with reference to the attached schematic drawings, which only show the parts necessary for understanding the invention.

DETAILED DESCRIPTION OF VARIOUS EMBODIMENTS OF THE INVENTION

Figure 1:
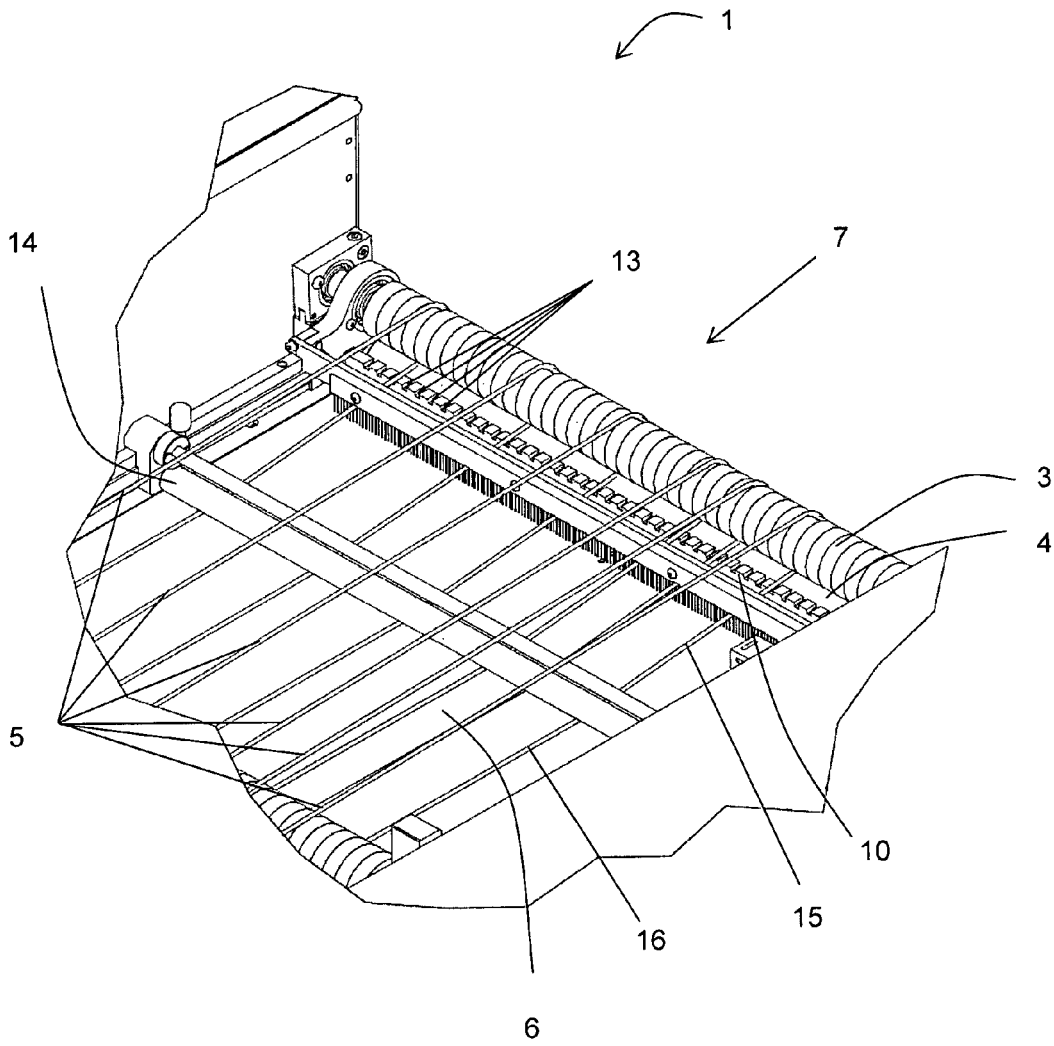
FIG. 1 depicts a view of part of the arrangement with rolls, lifting means and belt elements.

FIG. 1 depicts part of an arrangement (1) in the form of an active portion of the arrangement (1) for making it possible to convey sheets, preferably thin sheets, through the arrangement (1). The arrangement according to FIG. 1 has an upper receiving roll (3), a lower receiving roll (4), an upper belt element (5), a receiving surface (6) and a lifting means (10). The upper belt element (5) takes the form of a number of bands extending partly in an oval path above the receiving surface (6) and partly round the upper receiving roll (3). Sheets passing through the arrangement (not depicted in FIG. 1) are conveyed with a direction of movement (7) between and past the receiving rolls (3, 4). The lifting means (10) is situated after the receiving rolls (3, 4) in the direction of movement (7). The lifting means (10) comprises in an upper surface a number of grooves (13) which are parallel to the direction of movement (7). Each groove (13) is disposed vertically below a band of the belt element (5). This means that there are in the lifting means (10) at least as many grooves (13) as there are bands (5). As well as extending round the upper receiving roll (3), the belt element also extends round an adjustable roll (14) disposed in the direction of movement (7) at a distance from and after the lifting means (10) and the receiving rolls (3, 4). FIG. 1 shows the belt element (5) extending in a first span (15) from the underside of the upper receiving roll (3) to the underside on the adjustable roll (14). It also shows the belt element (5) extending in a second span (16) from the underside on the adjustable roll (14) in the direction of movement (7) towards an end roll (17) disposed on the arrangement (depicted in FIGS. 3 and 4).

Figure 2:
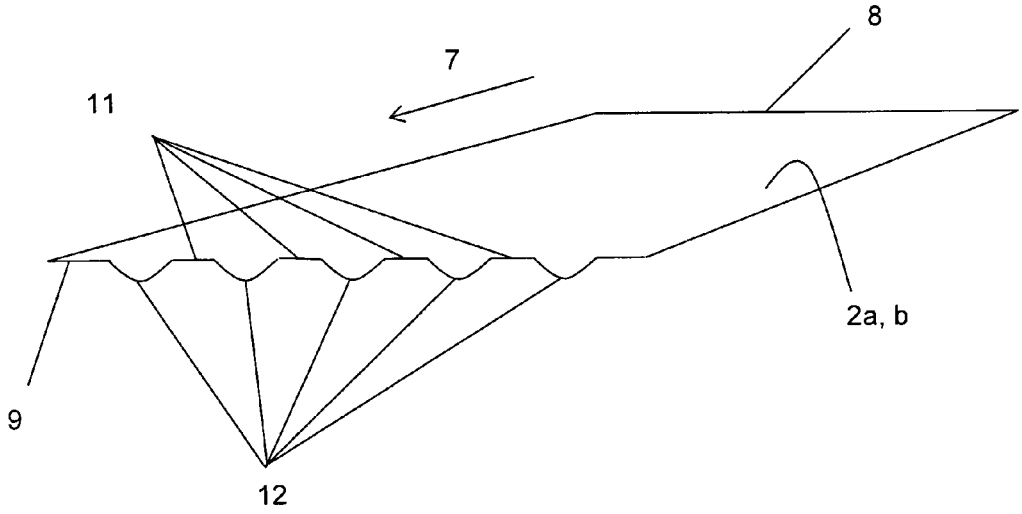
FIG. 2 depicts a sheet with a number of ridges and valleys formed by the arrangement.

FIG. 2 depicts a sheet (2*a, b*) comprising sides, a rear edge (8) and a front edge (9) and shows how it has been acted upon/shaped by being passed through the arrangement (1), between and past the receiving rolls (3, 4) and between the belt element (5) and the lifting means (10). As the first span (15) of the belt element (5), see FIG. 1, is situated over and in direct proximity to the respective grooves (13) on the lifting means (10), the belt element (5) acts upon a sheet such that it partly presses the front edge (9) of the sheet (2*a, b*) down into the grooves (13). The grooves (13) thus shape the sheet (2*a, b*) in the direction of movement so that it assumes a shape comprising a number of ridges (11) and valleys (12). As said ridges (11) and valleys (12) extend in the direction of movement (7) in the sheet (2*a, b*), they serve as beam elements in the latter whereby it is stiffened in the direction of movement (7). Said stiffening has the effect that a sheet (2*a, b*), preferably a thin sheet, does not deflect immediately after passing between and past the receiving rolls (3, 4) and that its front edge (9) will therefore land on the receiving surface (6) instead.

Figure 3:
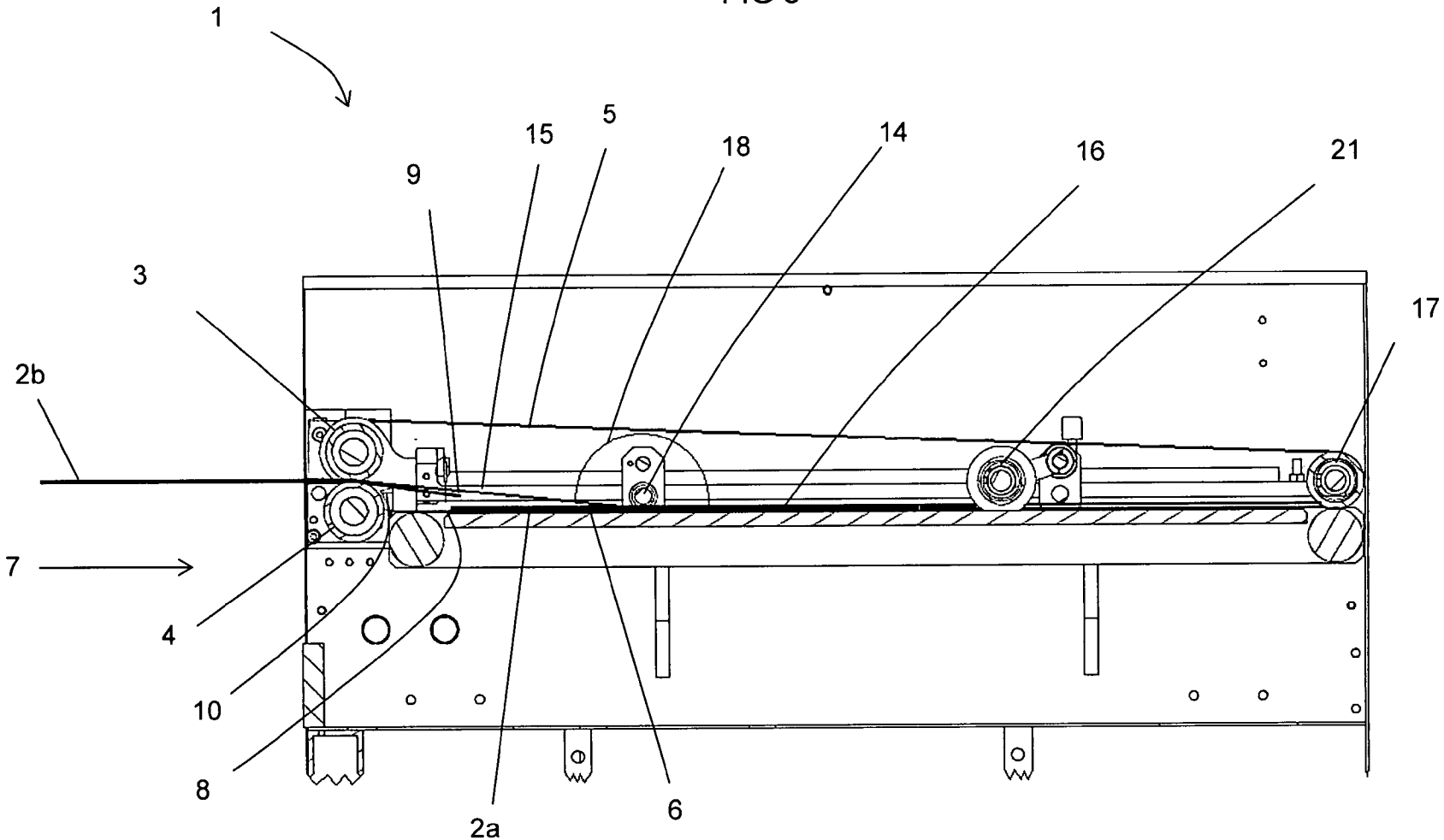
FIG. 3 depicts part of the inside of the arrangement and how sheets pass through the arrangement to enable them to be mutually sequenced in a pattern resembling a pattern of fish scales.

FIG. 3 depicts an embodiment of the invention for placing sheets mutually in line in an overlapping sequence. The embodiment of the arrangement (1) according to FIG. 3 comprises the elements which are necessary in the sheet handling process. In the arrangement (1) according to FIG. 3, sheets (2*a, b*) enter the arrangement (1) from the left side when the arrangement (1) is viewed from in front. A first sheet (2*a*) has been conveyed between an upper receiving roll (3) and a lower receiving roll (4) in the direction from left to right in and through the arrangement (1). After passing between and past said upper and lower receiving rolls (3, 4), the sheet (2*a*) runs over a lifting means (10). As previously mentioned, the sheets (2*a, b*) are conveyed in the direction of movement (7) which in FIG. 3 is from left to right as viewed from in front of the arrangement (1). The lifting means (10) is situated, as viewed in the direction of movement (7), after said upper and lower receiving rolls (3, 4). When the first sheet (2*a*) has passed over the lifting means (10), the first sheet (2*a*) lands on a receiving surface (6). The receiving surface takes with advantage the form of a number of bands. An upper belt element (5) extends in direct proximity to and partly above the lifting means (10). The upper belt element (5) and the outer roll surface of the upper and lower receiving rolls (3, 4) run at the same speed. The upper belt element (5) helps to move the sheet (2*a, b*), after the receiving rolls (3, 4), over and past the lifting means (10).

When the sheet (2*a, b*) arrives on the receiving surface (6), the speed of the sheet (2*a, b*) is altered by its movement being reduced. This is because the receiving surface (6) moves at a slower speed than the upper belt element (5). The upper belt element (5) is situated above the lower belt element/receiving surface (6) at a distance such that the speed of the sheet (2*a, b*) through the arrangement (1) is only affected by the receiving surface (6).

Sheets (2*a, b*) passing through the arrangement position themselves such that a front edge (9) of a sheet (2*b*) is positioned overlapping a rear edge (8) of a previous sheet (2*a*) passing through the arrangement (1). The fact that the previous sheet (2*a*) when it is placed/lands on the receiving surface thereby reduces its speed makes it possible for the front edge (9) of a following second sheet (2*b*) travelling at a higher speed and at a higher level over and past the lifting means (10) to be placed on top of and overlap the rear edge (8) of the previous sheet (2*a*).

As previously mentioned, each sheet (2*a, b*) is stiffened by being formed between the lifting means (10) and the upper belt element (5) so that the sheet assumes a shape with ridges (11) and valleys (12) which serve as stiffening beam elements in the respective sheet (2*a, b*). This stiffening of the front edge (9) enables the sheet (2*a, b*) to travel so far past and above the rear edge (8) of a preceding and previous sheet (2*a*) so that the front edge (9) of the second sheet (2*b*) is placed/lands on top of and past the rear edge (8) of the previous sheet (2*a*).

The upper belt element (5) and the receiving surface (6) according to the embodiment in FIG. 3 constitute a continuous band running in an oval path.

The upper belt element (5) extends between and partly round the upper receiving roll (3) and partly round an end roll (17). An adjustable roll (14) is enclosed by said belt element (5) in its oval span round said receiving roll (3) and end roll (17). Said rolls (3, 14, 17) are connected via their respective end portions to a frame portion. As previously mentioned, the upper belt element (5) has a lower portion extending partly in a first span (15) from a first underside on the upper receiving roll (3) to a second underside on the adjustable roll (14) and partly in a second span (16) from the second underside on the adjustable roll (14) to a third underside on the end roll (17). From an upper side on the end roll (17) the upper portion of the upper belt element (5) extends to an upper side on the upper receiving roll (3).

The first span (15) and the second span (16) of the belt element (5) meet at a point situated on said second underside of the adjustable roll (14). At their mutual meeting point said first and second spans (15, 16) form an angle (18) depicted in the diagram as an angle arc. This angle (18) is open upwards. The second span (16) is parallel with the receiving surface (6).

The adjustable roll (14) is connected via its respective end portions to a movement device which is itself movably connected to the respective frame portion. The upper receiving roll (3) is situated at a higher level than the adjustable roll (14) and the end roll (17) relative to a horizontal plane through the second span (16) forming part of the belt element (5). This means that movement of the adjustable roll (14) towards the upper receiving roll (3) will bring the first span (15) closer, and at a sharper angle, to the lifting means (10) while at the same time the angle between said first and second spans (15, 16) becomes smaller.

According to an embodiment of the invention, the arrangement (1) comprises a braking wheel (21), see FIG. 3. The braking wheel (21) causes overlapping sheets (2*a, b*) placed mutually in line on the receiving surface (6) to have a constant or predetermined distance between the respective front edges (9) of the successive overlapping sheets (2*a, b*) in the row.

Figure 4:
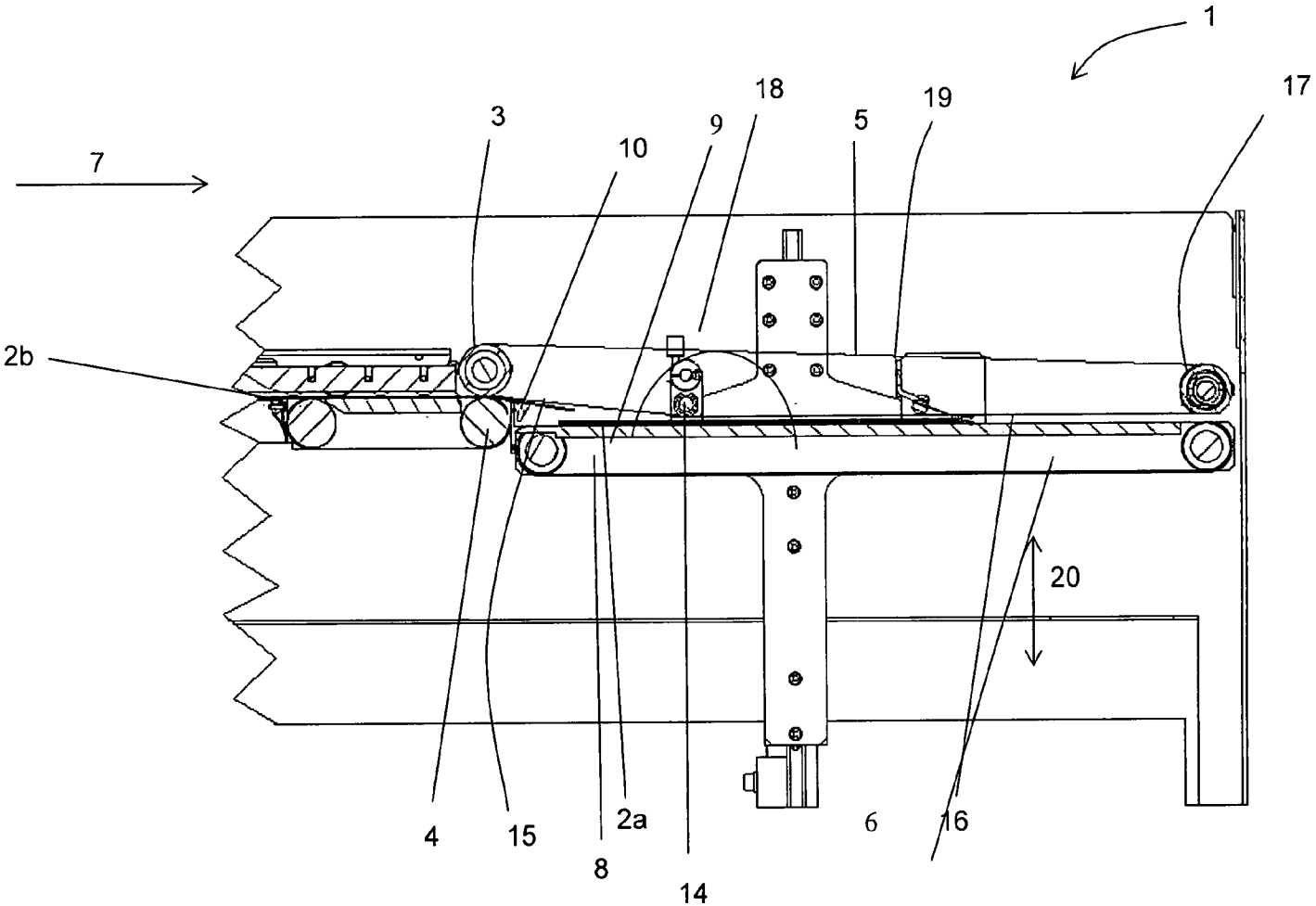
FIG. 4 depicts part of the inside of the arrangement and how sheets pass through the arrangement to enable them to be placed on one another in order to form a stack.

FIG. 4 depicts an embodiment of the invention in which sheets are placed in an overlapping sequence to form a stack of sheets. As previously mentioned, the sheets (2*a, b*) are conveyed through the arrangement (1), between and past the receiving rolls (3, 4) and over the lifting means (10) before landing on the receiving surface (6). According to an embodiment of the invention depicted in FIG. 4, the receiving surface (6) can move both downwards and upwards (20). Each time a sheet (2*a, b*) is placed on it, the receiving surface (6) performs said downward movement (20). A stop element (19) is disposed on the arrangement (1) according to the embodiment of the invention in FIG. 4. The purpose of the stop element (19) is to prevent sheets from continuing to slide over and past a preceding and underlying sheet on the receiving surface (6). The result is mutual stacking of the sheets (2*a, b*) in a stack while at the same time the receiving surface (6) and the sheets (2*a, b*) move downwards. When a desired height of stack has been reached or a desired number of sheets have been stacked, the sheets are conveyed away from the arrangement (1) by the receiving surface (6) comprising a number of bands which convey the stack away from it.

The invention is not limited to the embodiment depicted but may be varied and modified within the scope of the claims set out below, as partly described above.

The invention claimed is:

1. An arrangement (1) for conveying of sheets (2*a, b*), which arrangement (1) comprises:

an upper receiving roll (3), a lower receiving roll (4), at least one upper belt element (5) and a receiving surface (6), which upper belt element (5) extends in a region above the receiving surface (6), which sheets (2*a, b*) are conveyed in a substantially horizontal direction of movement (7) towards the receiving rolls (3, 4), which receiving rolls (3, 4) during rotation move the sheets (2*a, b*) one after another between and past the receiving rolls (3, 4), whereupon the respective sheets (2*a, b*), after passing through and between the receiving rolls (3, 4), are placed between said receiving surface (6) and upper belt element (5), which sheets (2*a, b*) between the upper belt element (5) and the receiving surface (6) are placed on one another such that a rear edge (8) of a sheet (2*a*) passing through and between the receiving rolls (3, 4) is overlapped by a front edge (9) of a following sheet (2*b*), characterized in that a lifting means (10) is situated in the sheet movement direction (7) after the receiving rolls (3, 4) and is adapted to acting upon sheets (2*a, b*) passing through the receiving rolls (3, 4) and over the lifting means such that the front edge (9) of a sheet (2*b*) which has passed over and past the lifting means (10) assumes a shape which strengthens it in the sheet movement direction (7);

and that the lifting means (10) acts upon the front edge (9) in a forward portion of the sheet (2*a, b*), as viewed in a section through said forward portion of the sheet (2*a, b*) and transversely to the direction of movement (7) of the sheet (2*a, b*), by the sheet (2*a, b*) being conveyed over the lifting means so that the front edge (9) and the sheet (2*a, b*) assume a wavy shape comprising a number of ridges (11) and valleys (12), which ridges (11) and valleys (12) are parallel with the direction of movement (7), the sheet (2*a, b*) thus being stiffened in said direction of movement (7);

wherein the lifting means (10) comprises a number of grooves (13) extending in the direction of movement (7) in a surface of the lifting means (10), which surface said sheets (2*a, b*) pass over;

and the grooves (13) in the surface of the lifting means (10) are deeper on the side of the lifting means (10) which faces away from the receiving rolls (3, 4) than the grooves (13) in the portion of the surface of the lifting means (10) which is situated closer to the receiving rolls (3, 4); and that said grooves (13) in the lifting means (10) are so configured that the upper belt element (5), by its configuration, fits in the grooves (13).

2. An arrangement (1) for conveying of sheets (2*a, b*) according to claim 1, characterized in that the grooves (13) are disposed in the lifting means (10) vertically below the respective bands of the upper belt element (5) which extend above said lifting means (10), the lifting means comprising at least as many grooves (13) as the number of bands of the upper belt element (5).

3. An arrangement (1) for conveying of sheets (2*a, b*) according to claim 1, characterized in that the lifting means (10) is an elongate means with a length corresponding to at least the width of a sheet (2*a, b*) which passes between the receiving rolls (3, 4), which lifting means (10) is situated parallel to said receiving rolls (3, 4).

4. An arrangement (1) for conveying of sheets (2*a, b*) according to claim 1, characterized in that the surface of the lifting means (10), which surface said sheets (2*a, b*) pass over, is adjustable by the lifting means (10) being adjustable in the height direction and rotatable about an axis through the lifting means (10).

5. An arrangement (1) for conveying of sheets (2*a, b*) according to claim 1, characterized in that the arrangement comprises an adjustable roll (14) situated in the direction of movement (7) of the sheet (2*a, b*) after and parallel to the receiving rolls (3, 4) at a distance such that the lifting means (10), as viewed in the direction of movement (7), is situated between the upper receiving roll (3) and the adjustable roll (14).

6. An arrangement (1) for conveying of sheets (2*a, b*) according to claim 1, characterized in that part of the upper belt element (5) extends partly in a first span (15) and partly in a second span (16), which first span (15) extends from an underside on the upper receiving roll (3) to an underside on the adjustable roll, which second span (16) extends in the direction of movement (7) from the underside on the adjustable roll (14) to an underside on an end roll (17), which first span (15) and second span (16) jointly form at their meeting point on the underside on the adjustable roll (14) an angle (18) of less than 180° upwards towards the upper belt element (5).

7. An arrangement (1) for conveying of sheets (2*a, b*) according to claim 1, characterized in that the angle (18)

between the first and second spans (15, 16) becomes smaller upon movement of the adjustable roll (14) in a parallel direction towards the receiving rolls (3, 4).

8. An arrangement (1) for conveying of sheets (2*a, b*) according to claim 1, characterized in that the lifting means (10) acts upon the rear edge (8) of a sheet (2*a, b*) passing over the lifting means (10) such that said rear edge (8), after passing over and past the lifting means (10), is caused to move towards the receiving surface (6) at a speed higher than the speed which the receiving surface (6) has in its movement in a direction away from the receiving rolls (3, 4).

9. An arrangement (1) for conveying of sheets (2*a, b*) according to claim 1, characterized in that the receiving surface (6) is a continuous belt means which has an upper portion parallel with part of the upper belt element (5), which portion of the upper belt means and said part of the upper belt element (5) both run in the same direction of movement, which said part of the upper belt element (5) moves at a speed higher than the speed at which said portion of the belt means moves.

10. An arrangement (1) for conveying of sheets (2*a, b*) according to claim 1, characterized in that the movement of each sheet (2*a, b*) in the direction of movement (7), after passing over and past the lifting means (10), is reduced by the front edge (9) of the sheet reaching a braking wheel (21), whereupon the respective sheet (2*a, b*) is placed on top of a preceding sheet (2*a, b*) such that the respective front edge (9) of adjacent sheets (2*a, b*) on the receiving surface (6) overlaps the rear edge (8) of a preceding sheet on the receiving surface (6).

11. An arrangement (1) for conveying of sheets (2*a, b*) according to claim 1, characterized in that the movement of each sheet (2*a, b*) in the direction of movement (7), after passing over and past the lifting means (10), is halted by the front edge (9) of the sheet reaching a stop membrane (19), whereupon the respective sheet (2*a, b*) is placed on top of a preceding sheet (2*a, b*) in a stack on the receiving surface (6).

12. An arrangement (1) for conveying of sheets (2*a, b*) according to claim 1, characterized in that each time a sheet (2*a, b*) is placed on the receiving surface (6), the latter performs a downward movement (20) such that a vertical stack of sheets (2*a, b*) is created on the receiving surface (6).

* * * * *